US005567514A

United States Patent [19]

Gold

[11] Patent Number: 5,567,514

[45] Date of Patent: Oct. 22, 1996

[54] PACKAGING CODING SYSTEM AND METHOD FOR EMPLOYING SAME

[76] Inventor: Peter N. Gold, 465 N. Wood Rd., Rockville Centre, N.Y. 11570

[21] Appl. No.: 520,271

[22] Filed: Aug. 28, 1995

[51] Int. Cl.[6] ..... B32B 7/12; G01B 3/10

[52] U.S. Cl. ..... 428/350; 428/343; 428/351; 33/758; 206/411; 427/207.1

[58] Field of Search ..... 33/758, 761; 428/350, 428/343, 351, 194, 906; 206/411; 427/207.1

[56] References Cited

U.S. PATENT DOCUMENTS 4,149,320 4/1979 Troyer et al. ..... 33/758

4,351,113 9/1982 Eggertsen et al. ..... 33/758

5,151,328 9/1992 Gold ..... 428/350 X

*Primary Examiner*—Daniel Zirker

*Attorney, Agent, or Firm*—Galgano & Burke

[57] ABSTRACT

A packaging coding system including at least one roll of moisture-activated adhesive-backed tape with a top side and an underside and two lateral edges, and a layer of moisture-activated adhesive applied to the underside of the tape. The tape has oil absorbed into one or both lateral edges to provide flexibility, waterproofing, and a vapor barrier to prevent activation of the adhesive when the tape is rolled up and at least one colored ink applied to at least one edge of the tape in a predetermined discrete position which serves to code the tape.

12 Claims, 2 Drawing Sheets

| *Symbol* | *Color* | *Number* |
|---|---|---|
| | Silver | 0 |
| | Blue | 1 |
| | Red | 2 |
| | Green | 3 |
| | Brown | 4 |
| | Black | 5 |
| | Orange | 6 |
| | Purple | 7 |
| | Yellow | 8 |
| | White | 9 |

PACKAGING CODING SYSTEM AND METHOD FOR EMPLOYING SAME

BACKGROUND OF THE INVENTION

Field of the Invention

The present invention relates to packaging dating systems and/or systems for coding packages and a method for employing the same. More particularly, the present invention relates to a packaging dating system and method which employs a moisture-activated adhesive-backed packaging tape having color-coded markings on the tape for use in dating packages.

DESCRIPTION OF THE PRIOR ART

Packaging systems utilizing various coding systems have a long history in the art, but for the most part are expensive, overly complex and impracticable. For example, starting with the advent of the computer and up until present day, coding systems for even the most mundane activities have become increasingly sophisticated and in most instances require numerous hours conversion and training to change from one system to another. However, there is a present need for a simplified packaging system which would require little training, labor and relatively minimal conversion costs.

Such a simplified dating system might, e.g., simply provide a dated packaging tape or label, i.e., packaging tape with the date pre-printed thereon or applied by a stamp. However, this would either require expensive pre-printed rolls which could only be used on the date printed or require time-consuming date stamping on each piece of tape as it is used. Moreover, such a numeral dating system might be undesirable as the shipper might wish to keep such information confidential. While a color-coded dating system would overcome this latter problem, it would still be necessary to use expensive pre-printed and pre-dated (and possibly date-expired if not used on the pre-printed date) color-coded packaging tape. In addition, the labor and time involved in color coding each individual piece of tape as it is applied to a package would make the coding system impracticable.

SUMMARY OF THE INVENTION

Accordingly, it is an object of the present invention to provide a packaging coding and/or dating system and method which eliminates the drawbacks of the prior art packaging systems and which is economical to manufacture, flexible, and relatively of simple construction and design.

It is another object of the invention to provide such a novel packaging coding/dating system and method which allows the use of relatively inexpensive, moisture-activated adhesive-backed tape which can be quickly and easily color coded by the packager and/or shipper.

It is a more specific object of the present invention to provide such a novel packaging coding/dating system and method in which at least one colored ink is applied to at least one edge of the moisture-activated adhesive-backed tape to represent a specific date, time and/or event without requiring the uncoiling of the tape to apply the ink.

More particularly, it is an object of the present invention to provide such a packaging dating system and method in which a plurality of colored inks are applied to one or both of the edges of a pre-treated moisture-activated adhesive-backed tape enabling the utilization of a highly sophisticated yet simple packaging coding system according to one's specific needs.

Certain of the foregoing and related objects are attained in accordance with the present invention by the provision of a packaging dating system having at least one roll of moisture-activated adhesive tape comprising a top and underside and two lateral edges. The tape includes a layer of moisture-activated adhesive applied to the underside of the tape. The lateral edges of the tape are pre-treated with oil so that the oil is absorbed into both edges to provide flexibility, waterproofing, and a vapor barrier to prevent premature activation of the adhesive when the tape is rolled up. The system additionally comprising at least one colored ink or the like radially applied to at least one edge of the tape in a predetermined discrete position corresponding to a specific event such as the time and/or date; the oiled edges of the tape preventing the ink from activating the tape adhesive and causing the tape's plies from sticking together.

Preferably, colored ink is applied to a single edge of the tape, but in some instances it may be desirable to apply colored ink to both edges of the tape for further codifying purposes. Advantageously, a sequential series of differently colored ink spots are used to represent numerals from one to ten and the packages are encoded according to a desired numeric format, e.g., the shipping, delivery and/or expiration date, or the delivery number of an item.

Certain of the foregoing and related objects are also attained in accordance with the present invention by the provision of a method for creating a packaging coding system, comprising the steps of saturating at least one edge of at least one roll of moisture-activated adhesive-backed tape having a top side in oil and applying at least one colored ink to at least one edge of the roll of tape so that it bleeds into the top side in a predefined discrete position which serves to code the tape.

Preferably, the method for creating a packaging coding system further comprises the step of applying a strip of the encoded tape to a package. Most desirably, at least one colored ink is applied to at least one edge of the roll of the tape in a radial fashion extending from a center section of the roll of the tape to an outermost ply thereof.

Advantageously, the method for creating a packaging coding system further comprises the step of applying a plurality of differently colored inks in discrete radially spaced-apart stripes on at least one lateral edge of the roll of the tape in a predetermined positional pattern which, taken as a whole, serves as a repeating code on the tape corresponding to a specific desired event. Most desirably, the plurality of colored inks, taken as a whole, correspond to a desired date in numerical form. Preferably, the method further comprises the step of applying at least one of the plurality of colored inks to the opposite lateral edge of the roll in a predefined discrete position for additional codifying purposes.

BRIEF DESCRIPTION OF THE DRAWINGS

Other objects and features of the present invention will become apparent from the following detailed description considered in connection with the accompanying drawings which disclose one embodiment of the present invention. It should be understood, however, that the drawings are designed for the purpose of illustration only and not as a definition of the limits of the invention.

In the drawings, wherein similar reference characters denote similar elements throughout the several views.

DETAILED DESCRIPTION OF THE PREFERRED EMBODIMENT

Figure 1:
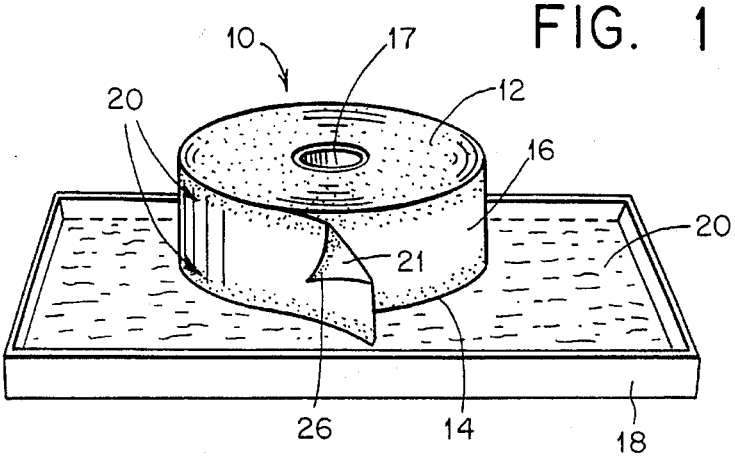
FIG. 1 is a perspective view of a roll of moisture-activated adhesive-backed tape being treated by having the edges soaked in oil in accordance with a first step of the present invention.

Turning now in detail to the appended drawings, and in particular FIG. 1, therein illustrated is a conventional roll of moisture-activated, adhesive-backed tape 10 having two lateral or side edges 12 and 14, a center web section 16, and a center core element 17. A conventional moisture-activated adhesive 26 is disposed on the underside of tape 10. FIG. 1 illustrates a first step in preparing or treating the tape 10 prior to the application of color-coded inks, the purpose of which will be explained in greater detail hereinafter. As shown therein, tape 10 is disposed or dipped in tray 18 filled with oil 20, preferably motor oil, so that the edge 14 thereof becomes saturated with oil 20. Thereafter, tape 10 is removed from the tray and turned upside down and re-dipped into oil 20 so that edge 12 is also placed into contact with oil 20 so as to saturate edge 12 with the same. This procedure is more fully described in my prior U.S. Pat. No. 5,151,328 the subject matter of which is incorporated herein by reference thereto.

Figure 2:
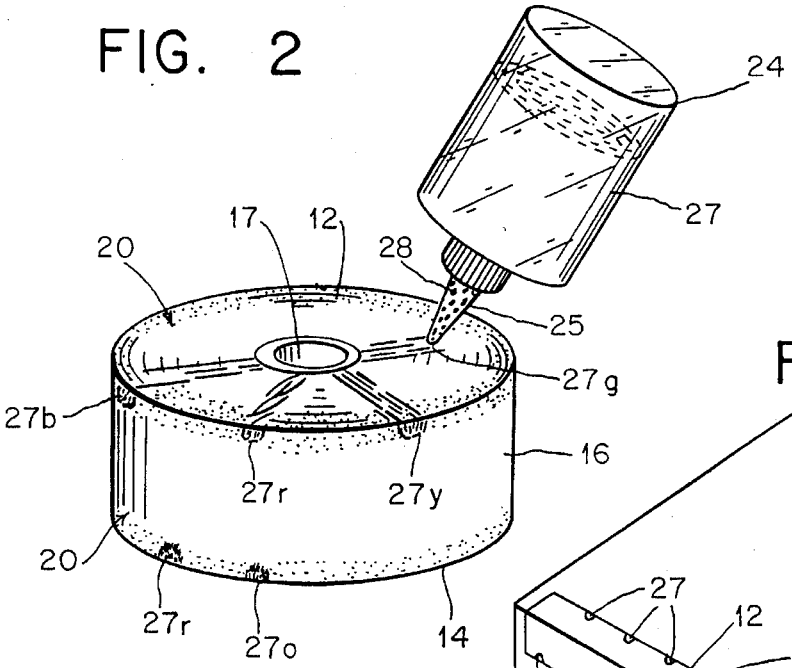
FIG. 2 is a perspective view showing colored ink being applied in a coded fashion to the oil-treated edges of the tape in accordance with a second step of the invention.

After the saturated oiled edges are relatively dry, the tape roll 10 is then ready for color coding as shown in FIG. 2. More specifically, a clear plastic squeeze bottle 24 having a funnel shaped nozzle 25 and containing a colored liquid ink 27, preferably a conventional quick drying printer's ink, is utilized to color code edge 12 of tape 10. Preferably, ink 27 is applied in a radially-extending colored ink stripe to the lateral edge of the roll, starting from its center core 17 to its outermost tape layer or ply. The nozzle 25 has a foam insert 28 so as to provide a controlled discharge of ink 27 from bottle 24.

As seen in FIG. 2, ink 27 partially soaks through edges 12 and 14 leaving an identifying mark 27 on the topside 16 and underside 21 of tape 10. Since the entire edge 12 of tape 10 is saturated with oil 20, ink 27 does not activate adhesive 26 and bond tape 10 in a coiled position; the oil 20 prevents the colored ink 27 from activating adhesive 26 on underside 21 of tape 10 and causing the individual tape plies to stick together which would occur if the oil bath treatment of the tape did not occur first.

By using a series of different bottles containing differently colored inks, e.g. green, red, yellow and blue, and applying them in radially-spaced apart stripes in a predetermined or predefined fashion to edges 12 and 14, tape 10 can be encoded. For example, each colored ink applied to edges 12 and 14 and the marks which result therefrom can represent a different numeral and/or letter. By applying a specific series of colored inks in radial or similar fashion along each edge 12 or 14, various information pertaining to a shipment of packages can be maintained such as the shipping, receiving and/or expiration date, item number, manufacturer's name, etc. As depicted in FIG. 2, colored inks **27*b* (blue), 27*r* (red), 27*y* (yellow) and 27*g* (green) leave residual stripes on edge 12 and generally semicircular marks appear on top face 16 along edge 12. Likewise, colored inks 27*r* (red) and 27*o* (orange) and their corresponding marks are shown applied to opposite edge 14 thereby further encoding tape 10** for its intended purpose.

Figure 3:
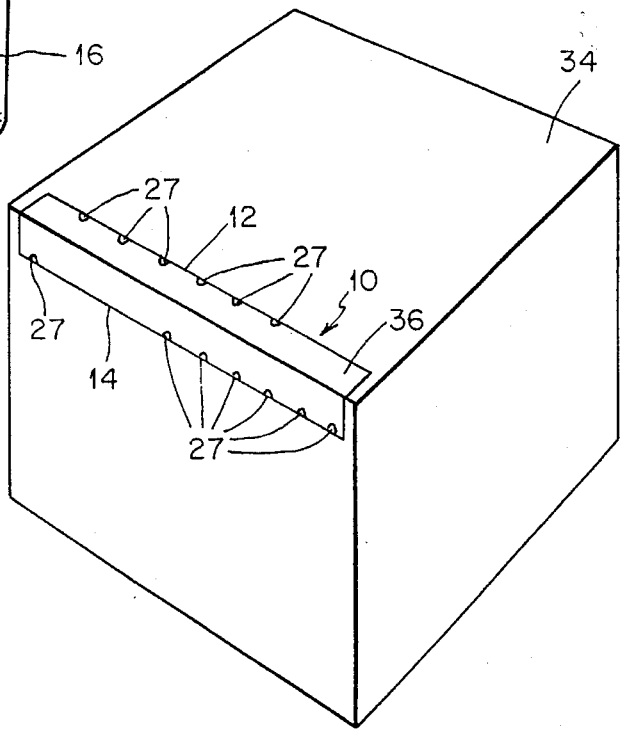
FIG. 3. is a perspective view showing the encoded packaging tape applied to a carton.

As illustrated in FIG. 3, after encoding edges 12 and/or 14 of tape 10 with the desired information, a single strip 36 of tape 10 can then be affixed to a package 34 thereby dating and/or marking the package for inventory or other purposes.

Figures 4, 5:
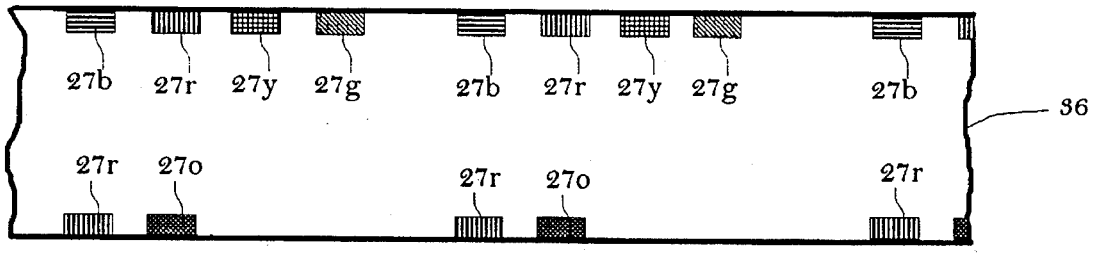
FIG. 4. is a table of the color-coding employed on the tape and the numbers they represent.
FIG. 5 is an enlarged, fragmentarily-illustrated plan view of an example of color-coded packing tape according to the invention.

FIG. 4. shows an example of a typical table for use in color-coding the tape. Each color corresponds to a specific number and a series of numbers or a particular arrangement of numbers can represent a specific date and/or item number. Preferably, each color corresponds to a specific number, but in some cases it may be desirable for each color to correspond to a specific letter, manufacturer, and/or other desired reference item.

An example of a packaging tape color-coded according to the present invention is shown in FIG. 5. The top edge of tape 10 exhibits colored marks **27*b*, 27*r*, 27*y* and 27*g* which represent those colors that were applied to edge 12. Using the color table from FIG. 4 and matching the specific color with its corresponding number, the colors blue, red, yellow, and green represent the numbers 1, 2, 8, 3 which in this particular example represent the month (12) and year (83), respectively, or, "December, 1983". Likewise, the bottom edge of tape 10 exhibits colored marks 27*r* and 27*o* which colors were applied to edge 14, i.e., red and orange, which represent the numbers 2 and 8 which in this example represent the day of the month, or "28", respectively. Therefore, the encoded tape 10 illustrated in the accompanying FIGS. 2 and 5** is encoded with the date Dec. 28, 1983.

As further shown if FIG. 5, the coding patterns or scheme is repeated along the tape 10 as it is uncoiled. As a result, it is not necessary to require that tape 10 be cut at a predetermined point to ensure proper coding of a package.

Various modifications may be made as will be apparent to those skilled in the art. For example, while it is preferable to use a minimal number of colored inks to encode tape 10, any number of inks may be used if desired. In addition, different types of information may be stored on each respective edge of tape 10 to further categorize and/or sort packages 34.

Moreover, ink 27 may be applied using any particular means such as, for example, a felt marker or inked stripe pad.

Preferably, tape 10 is soaked in a tray of oil 20 or in accordance to one of the other methods described in the Gold '328 patent such as by roller or spray, but in some instances it may be desirable apply the oil in a different or more economic fashion. In addition, while it is desirable to use a motor oil such as 30 weight motor oil for waterproofing purposes, it may be desirable to use another type of oil which is more or less compatible with ink 27.

Most desirably, the ink is applied in radially spaced-apart stripes to the edges 12 and 14 of the tape 10 at predetermined clock-oriented positions, i.e., at the 12, 3, 6, and 9 o'clock positions of a conventional clock face, but in some instances it may be desirable to apply ink 27 in a different fashion depending upon the desired complexity of the system.

Accordingly, while only one embodiment of the present invention has been illustrated in the appended drawings, it is to be understood that various modifications may be made as will be apparent to those skilled in the art.

What is claimed is:

1. A packaging coding system, comprising:

at least one roll of moisture-activated adhesive tape with a top side and an underside and two lateral edges, and including a layer of moisture-activated adhesive applied to the underside of the tape, said tape having oil absorbed into both lateral edges to provide flexibility, waterproofing, and a vapor barrier to prevent activation of said adhesive when said tape is rolled up and inked; and at least one colored ink applied to at least one edge of said tape so that it bleeds onto said top side of said tape in a predetermined discrete position which serves to code sand tape.

2. The packaging coding system according to claim 1 wherein a plurality of differently colored inks are applied in discrete radially spaced-apart stripes on at least one lateral edge of said roll of said tape in a predetermined positional pattern which, taken as a whole, serves as a repeating code on said tape corresponding to a specific desired event.

3. The packaging coding system according to claim 1, wherein said at least one colored ink is applied to both edges said roll.

4. The packaging coding system according to claim 2, wherein said plurality of colored inks, taken as a whole, correspond to a desired date in numerical form.

5. The packaging coding system according to claim 4, wherein at least one of said plurality of colored inks is applied to the opposite lateral edge of said roll of said tape in a predefined discrete position for additional codifying purposes.

6. The packaging coding system according to claim 2 wherein said stripes of said colored inks are applied in a radial fashion to said lateral edge of said tape extending from a center section of said roll of said tape to an outermost ply thereof.

7. A method for creating a package coding system, comprising the steps of:

saturating at least one edge of at least one roll of moisture-activated adhesive-backed tape having a top side and two lateral edges in oil;

applying at least one colored ink to said at least one lateral edge of said roll of tape so that it bleeds into said top side in a predefined discrete position which serves to code said tape.

8. The method for creating a packaging coding system according to claim 7, further comprising the step of applying a strip of said coded tape to a package.

9. The method for creating a packaging coding system according to claim 7, wherein said at least one colored ink applied to said at least one lateral edge of said roll of said tape in a radial fashion extending from a center section of said roll of said tape to an outermost ply thereof.

10. The method for creating a packaging coding system according to claim 7, further comprising the step of applying a plurality of differently colored inks in discrete radially spaced-apart stripes on said at least one lateral edge of said roll of said tape in a predetermined positional pattern which, taken as a whole, serves as a repeating code on said tape corresponding to a specific desired event.

11. The method for creating a packaging coding system according to claim 10, wherein said plurality of colored inks, taken as a whole, correspond to a desired date in numerical form.

12. The method for creating a packaging coding system according to claim 10, further comprising the steps of:

saturating both lateral edges of said roll of said tape in oil; and applying at least one of said plurality of colored inks to the other of said lateral edges of said roll in a predefined discrete position for additional codifying purposes.

* * * * *